US012110766B2

(12) United States Patent
Rahn et al.

(10) Patent No.: US 12,110,766 B2
(45) Date of Patent: Oct. 8, 2024

(54) DOWNHOLE CLEANING TOOL AND METHOD

(71) Applicant: Coretrax Global Limited, Aberdeen (GB)

(72) Inventors: Thilo Rahn, Aberdeen (GB); Scott Benzie, Aberdeen (GB); Ryan Low, Aberdeen (GB); Rafael Villa De Santana, Abderdeen (GB); Andrew Churchill, Aberdeen (GB)

(73) Assignee: CORETRAX GLOBL LIMITED, Portlethen (GB)

( * ) Notice: Subject to any disclaimer, the term of this patent is extended or adjusted under 35 U.S.C. 154(b) by 0 days.

(21) Appl. No.: 18/040,158

(22) PCT Filed: Aug. 6, 2021

(86) PCT No.: PCT/EP2021/025305
§ 371 (c)(1),
(2) Date: Feb. 1, 2023

(87) PCT Pub. No.: WO2022/028740
PCT Pub. Date: Feb. 10, 2022

(65) Prior Publication Data

US 2023/0366295 A1 Nov. 16, 2023

(30) Foreign Application Priority Data

Aug. 7, 2020 (GB) ..... 2012313

(51) Int. Cl.
*E21B 37/04* (2006.01)

(52) U.S. Cl.
CPC ..... *E21B 37/04* (2013.01)

(58) Field of Classification Search
CPC ..... E21B 37/02; E21B 37/04
See application file for complete search history.

(56) References Cited

U.S. PATENT DOCUMENTS 4,589,504 A 5/1986 Simpson
2009/0025927 A1 1/2009 Telfer
(Continued)

FOREIGN PATENT DOCUMENTS

CA 1238631 A 6/1988
GB 2401384 A 11/2004
(Continued)

OTHER PUBLICATIONS

International Search Report and Written Opinion in related application PCT/EP2021/025305 dated Jan. 5, 2022.
(Continued)

*Primary Examiner* — David Carroll
(74) *Attorney, Agent, or Firm* — Patterson + Sheridan, LLP

(57) ABSTRACT

A downhole cleaning tool (120) for use in a drilled bore, such as an oil and gas well (100). The tool (120) comprises a tubular body (130) defining an internal bore (136) and at least one radially extending blade (148) defining a pocket (152) having sides and a base. A cam-activated radially extendable cleaning element (154) is mounted in the pocket (152) and is movable between a retracted position and an extended position. Multiple pockets (152) and cleaning elements (154) may be provided. The activating cam may be in the form of a pipe, which may be a single unitary part or may be in multiple parts. The parts of the multiple-part pipe may be axially spaced and may activate the cleaning elements in a staggered or sequential manner.

17 Claims, 11 Drawing Sheets

(56) References Cited

U.S. PATENT DOCUMENTS

| | | | | |
|---|---|---|---|---|
| 2011/0073371 | A1* | 3/2011 | Radford | E21B 10/322 175/57 |
| 2011/0186355 | A1* | 8/2011 | Telfer | E21B 37/02 175/84 |
| 2015/0090494 | A1* | 4/2015 | Lazarev | G06K 19/0772 175/40 |
| 2017/0074071 | A1* | 3/2017 | Tzallas | E21B 37/02 |

FOREIGN PATENT DOCUMENTS

| | | | |
|---|---|---|---|
| GB | 2447225 | A | 9/2008 |
| GB | 2524788 | A | 10/2015 |
| WO | 199928587 | A1 | 6/1999 |
| WO | 2005124094 | A1 | 12/2005 |
| WO | 2006016102 | A1 | 2/2006 |
| WO | 2010015861 | A2 | 2/2010 |
| WO | 2011121341 | A2 | 10/2011 |
| WO | 2012099668 | A2 | 7/2012 |

OTHER PUBLICATIONS

Search Report in related application GB2012313.9 dated Sep. 29, 2020.

* cited by examiner

DOWNHOLE CLEANING TOOL AND METHOD

FIELD

This disclosure relates to a cleaning tool and cleaning method. Examples of the disclosure relate to a scraper for treating downhole tubing.

BACKGROUND

In the oil and gas exploration and production industry drilled bores are lined with metal tubing. The internal surfaces of the tubing may become contaminated with material, for example drill cuttings or cement residue. An operator may elect to clean the tubing, for example to provide a surface suitable for the creation of a seal with a packer or the like.

There have been proposals for providing tubing cleaning apparatus in which cleaning elements are initially retained in a body in a retracted or dormant position. The cleaning elements may be extended when required, the extending cleaning elements then contacting the internal surface of the surrounding tubing. Multiple cleaning elements may be arranged and located such that full circumferential contact between the cleaning elements and the tubing may be achieved by axial reciprocation of the apparatus, without requiring rotation of the apparatus. Examples of such apparatus are described in, for example, U.S. Pat. Nos. 10,526,871 and 8,905,126.

In U.S. Pat. No. 10,041,333 a drilling assembly features retracted scrapers and a closed circulation sub so that the drilling can commence with string pressure delivered to bit nozzles due to the circulation sub being in a closed position. When drilling is done and the bit is to be removed, a ball lands on a seat on a sleeve that acts as a piston to break scraper retainers for casing scraping deployment and to open the circulation port. A bypass opens around the seated ball when the sleeve shifts to allow flow around the seated ball for circulation while scraping.

U.S. Pat. No. 8,955,584 describes a method of drilling and cleaning a wellbore while rotating the drill string after full drilling depth is reached without running the drill string out the bore to install a clean-up work string. A drill string having a drill bit at one end includes at least one near bit selectively activatable cleaning tool mounted within the length of the drill string, the cleaning tool having a cleaning member adapted to be moved from a close-fitting stowed configuration within a recess in the tool body to a deployed configuration. The recess extends through the tool body and an inner surface of the cleaning member engages a surface of an axially displaceable sleeve which acts as a cam member.

U.S. Pat. No. 10,526,871 describes a downhole cleaning apparatus comprising a tubular body with a plurality of openings therethrough. Each opening defines at least part of a helix extending longitudinally and circumferentially about the tubular body. The downhole cleaning apparatus also includes a plurality of cleaning elements. Each cleaning element is configured to extend through an opening and to extend outwards from an outer surface of the tubular body.

SUMMARY

An aspect of this disclosure relates to a downhole cleaning tool for location in a bore, the tool comprising a tubular body defining an internal bore and at least one radially extending blade defining a pocket having sides and a base, and a radially extendable cleaning element mounted in the pocket and movable between a retracted position and an extended position.

The base of the pocket may be substantially planar or may comprise a substantially planar portion. The cleaning element may have an inner surface and the surface may be substantially planar or may comprise a substantially planar portion. The inner surface of the cleaning element may engage the base of the pocket when the element is in the retracted position, and the engaging surfaces may coincide or match to provide a relatively large contact area therebetween. In the extended position the inner surface of the cleaning element may be radially spaced from the base of the pocket.

The tool may include a cam member, and the radially extendable element may be operatively associated with a cam follower for engaging the cam member. The cam member may be provided internally of the body and the cam follower may extend through the base of the pocket into contact with the cam member. The cam follower may extend through a relatively small area port or opening in the base of the pocket, which opening may be arranged to have a minimal impact on the strength and rigidity of the body. The cam member may comprise an axially extending member, such as a sleeve, pipe or tube, and may extend along the internal bore of the body. The cam member may be in a sliding, sealing relationship with a wall of the internal bore of the body to isolate fluid in the internal bore of the body from external fluid. The cam follower may comprise a radially extending plunger having an outer end for engaging the radially extendable element and an inner end for engaging the cam member. The cam member may be translatable relative to the cam follower and may include a cam surface for engaging an inner portion of the cam follower. The cam surface may include a first portion and a second portion. Relative movement of the cam surface relative to the cam follower may not induce any movement of the cam follower while the cam follower is in contact with the first portion, the cam follower only being moved radially outwards when in contact with the second portion.

Multiple cleaning elements may be provided. The cleaning elements may each be provided with an associated cam follower. The cleaning elements may be configured to be extended simultaneously or may be configured to be extended in a sequence. Sequential operation may be achieved by configuring the cam member to act on the cam followers in a sequential manner, for example the second portion on the cam surface may be in different positions relative to the respective cam followers or cleaning elements, resulting in a staggered cam action and a staggered deployment of the cleaning elements. Thus, the cleaning element deployment force generated by the cam member may be concentrated on a single cleaning element which is extended before the deployment force is applied to another cleaning element. This may be useful if retaining forces, such as friction or a shear retainer, must be overcome to extend the cleaning elements.

The cam member may be translated by any appropriate arrangement. In one example the cam member is engageable with an occluding member, such as a ball or dart, which permits creation of a fluid pressure differential across the occluding member, and creation of an axial fluid pressure force. The occluding member may be translatable from the cam member, or the cam member or the occluding member may be translatable to a position in which fluid may bypass the occluding member.

The radially extendable cleaning element may be biased towards the extended position. A spring or other biasing member may be provided to act between the base of the pocket and the cleaning element. One or more compression springs may be provided in combination with each cleaning element and multiple springs may be axially spaced along the element. The spring may be located within a blind bore in a rear face of the cleaning element. In other examples hydraulic pressure may be utilised to extend the cleaning element; in a drill string the pressure of the fluid being pumped down through the string is higher than the pressure of the fluid in the annulus surrounding the string, and the resulting pressure differential may be employed to exert a radial pressure force on the cleaning element.

The radial extension of the cleaning element may be restricted by a stop member. The stop member may extend between the cleaning element and the body. In one example a stop member extends through a radial bore in the cleaning element and engages the base of the pocket. The radial bore may be stepped, and the stop member may have a larger diameter head. The stop member may have a threaded end to engage with a corresponding threaded bore in the body. One or more stop members may be provided in each cleaning element. In another example the stop member may comprise a plate or other member fixed on the outside of the tool body and extending over a stepped cleaning element, or a stop member may extend through a slot in the element.

Where the cleaning element is provided in combination with a stop member and a biasing arrangement, the biasing arrangement may be adapted to urge the cleaning element to the maximum radial extension as permitted by the stop member. The stop member and the biasing arrangement may be adapted to permit a maximum radial extension of the cleaning element to describe a diameter larger than the diameter of tubing to be cleaned. Such an arrangement facilitates cleaning of inclined or horizontal tubing, where the weight of the tubing string will tend to offset the string to the low side of the tubing and will tend to urge the cleaning element radially inwards when engaging the low side of the tubing.

The radially extendable cleaning element may be releasably retained in the retracted position. One or more shear members may retain the cleaning element in the retracted position. A shear member, such as a shear pin, may extend between the cleaning element and another part of the tool. In one example a shear member extends between the cleaning element and an axially movable member, such as a cam member; the shear member may extend radially and be sheared on axial movement of the cam member relative to the tool body. Shearing of the shear member may be associated with initial movement of the cam member which may not produce any movement of an associated cam follower. In another example an elevated internal pressure may be generated to urge the cleaning member outwards from the retracted position to shear a retaining shear pin, or otherwise reconfigure a retaining arrangement. Such a pressure may be generated by temporarily blocking the through bore of the body using an occluding device such as a ball or dart. The occluding device could be subsequently sheared through a restriction, or the restriction shifted to permit fluid bypass around the device.

The radially extendable cleaning element and associated parts of the body may be adapted to minimise voids or spaces which may fill with material prior to activation of the tool and restrict movement of the cleaning element. When used in a drilling environment the tool will be located in drilling fluid carrying fine particulate material. This material tends to accumulate in and fill spaces and voids in downhole tools and in certain circumstances the tools may become "packed-off", where the accumulation of material prevents operation of the tool. Alternatively, or in addition, the tool may be configured to facilitate movement or displacement of such particulate material. For example, if the material accumulates in and bridges a clearance gap between the cleaning element and the pocket the material may create a seal and prevent or restrict movement of the element. However, if some larger gaps or other passages are provided these may be less likely to be bridged and will facilitate flow of fluid in behind the element. Also, if the element is subject to reciprocal movement material may be drawn in behind the element as the element is extended, and subsequent expelling of this material may be facilitated by the provision of such larger gaps and passages. One or both opposing cleaning element and pocket surfaces may be provided with a draft angle or taper to facilitate the widening of the gap therebetween as the cleaning element is extended.

The radially extendable cleaning element may take any appropriate form and may comprise a rigid member having surface or edge configurations adapted to scrape, mill, or otherwise dislodge material from a cylindrical tubing surface. Surfaces or edges of the element may be formed or coated with wear-resistant materials. Alternatively, or in addition, the cleaning element may include flexible material, such as bristles, brushes or wiping blades.

The tool may comprise multiple blades, which blades may be arranged at an angle to the body axis, that is the blades extend both axially and circumferentially around the body. The blades may collectively define one or more stabilisers. The blades may be separated by bypass flutes. A pocket may be included in two or more of the blades. The pocket may lie on an ellipse, that is an angled cross-section of the body. The pocket, and the associated cleaning element, may have parallel ends and sides and have a substantially rectangular form. Blades may be provided in a set or group, with the individual blades being spaced around a circumference of the body. Alternatively, or in addition, blades, or groups of blades, may be axially spaced along the body. The groups of blades may be circumferentially offset. The blades within a group may have a wrap angle of between 270 and 360° or more; the wrap angle for a blade is the angle from the front of the bottom or leading end of the blade to the back of the top or trailing end of the blade, and the wrap angle for the group is the sum of the wrap angles for each blade in the group. While the term "blades" is used herein, the skilled person will understand that this terminology is intended to encompass a variety of formations typically including a relatively thick body wall portion to accommodate the element-receiving pocket.

The body may be adapted for mounting in or on a tubing string, such as a string of drill pipe, and may be provided with appropriate end connectors, for example threaded connectors, such as pin and box connections. The body may be adapted to form part of a drill string and as such the body is configured to accommodate and withstand the torques and other forces associated with a drilling operation. The body may comprise one or more connected parts. For example, the body may be machined or otherwise formed from a single metal billet or may be from multiple parts.

The blade dimensions may be selected in accordance with the application and will typically be 8-16" (20.3-40.6 cm) long.

The tool may be incorporated in a drill string and remain in a dormant configuration, with the cleaning element in the retracted position, during tripping in and drilling. Before tripping out or retrieving the drill string the cleaning tool may be positioned at a selected location in the bore and the cleaning element extended to contact the bore wall, which may be the surface of casing or other bore-lining tubing. The cleaning tool is then translated such that the cleaning element moves over the surface, removing or dislodging surface contamination. The cleaned surface may facilitate the subsequent location and sealing of, for example, a liner hanger.

Multiple cleaning tools may be incorporated in a drill string at axially spaced tool locations. The tools may have different cleaning diameters. For example, a distal cleaning tool may describe a smaller cleaning diameter than a proximal cleaning tool, allowing an operator to treat or clean multiple locations in bore-lining tubing of different diameters.

A further aspect of the disclosure relates to a downhole tool comprising; a tubular body defining an internal bore permitting passage of fluid therethrough; first and second actuating members located in the bore; and an occluding member, the occluding member being translatable into engagement with the first actuating member to occlude the body bore and permit creation of a fluid-generated force for translating the first actuating member into engagement with the second actuating member and then translating the second actuating member.

Another aspect of the disclosure relates to a method of actuating a downhole tool, the method comprising: translating an occluding member into a first actuating member located in a body of a downhole tool; creating a fluid-generated force across the occluding member to translate the first actuating member through the body to engage a second actuating member located in the body; and utilising the fluid-generated force to translate the second actuating member through the body.

The tool may comprise a third actuating member and the second actuating member may be translatable into engagement with the third actuating member for translating the third actuating member.

The first actuating member and the second actuating member may comprise sleeves, pipes or tubes.

The first actuating member and the second actuating member may be initially releasably retained relative to the body, for example by shear couplings such as shear pins.

The first actuating member and second actuating member may be initially axially separated or spaced apart and may have opposing surfaces that are initially spaced apart, but which engage when the first actuating member is moved into engagement with the second actuating member.

The first actuating member may be located above the second actuating member in the body.

The tool may comprise a catcher or stop for the first and second actuating members.

The first actuating member and the second actuating member may comprise a coupling or latch arrangement whereby the first and second actuating members are coupled together or may become latched together on the first actuating member engaging the second actuating member.

The first and second actuating members may be axially movable relative to the body.

The tool may further comprise first and second actuatable members mounted on the body, the first actuatable member for cooperating with the first actuating member and the second actuatable member for cooperating with the second actuating member.

The first and second actuatable members may be radially movable relative to the body.

The first and second actuatable members may comprise cam followers, and the first actuating member and the second actuating member may comprise cam members for cooperating with the cam followers.

The first and second actuatable members may comprise cleaning elements.

These aspects of the disclosure may have utility in actuating tools comprising multiple actuatable elements, allowing the elements to be actuated in sequence, rather than simultaneously. The available actuating force may thus be applied to an individual actuatable element, and then to another individual actuatable element, and so on. Alternatively, the available actuating force may be applied to a releasable coupling, such as a shear coupling, and then to induce movement of the actuatable element.

These aspects may be utilised in a cleaning tool as described herein and may also be utilised in a range of other tools featuring multiple elements that require actuation.

The various features of the tools described above and in the appended claims may have utility in combination, and the features may also have individual utility and be provided in tools independently of the other features.

BRIEF DESCRIPTION OF THE DRAWINGS

These and other aspects of the disclosure will now be described, by way of example, with reference to the accompanying drawings, in which.

DETAILED DESCRIPTION OF THE DRAWINGS

Figure 1:
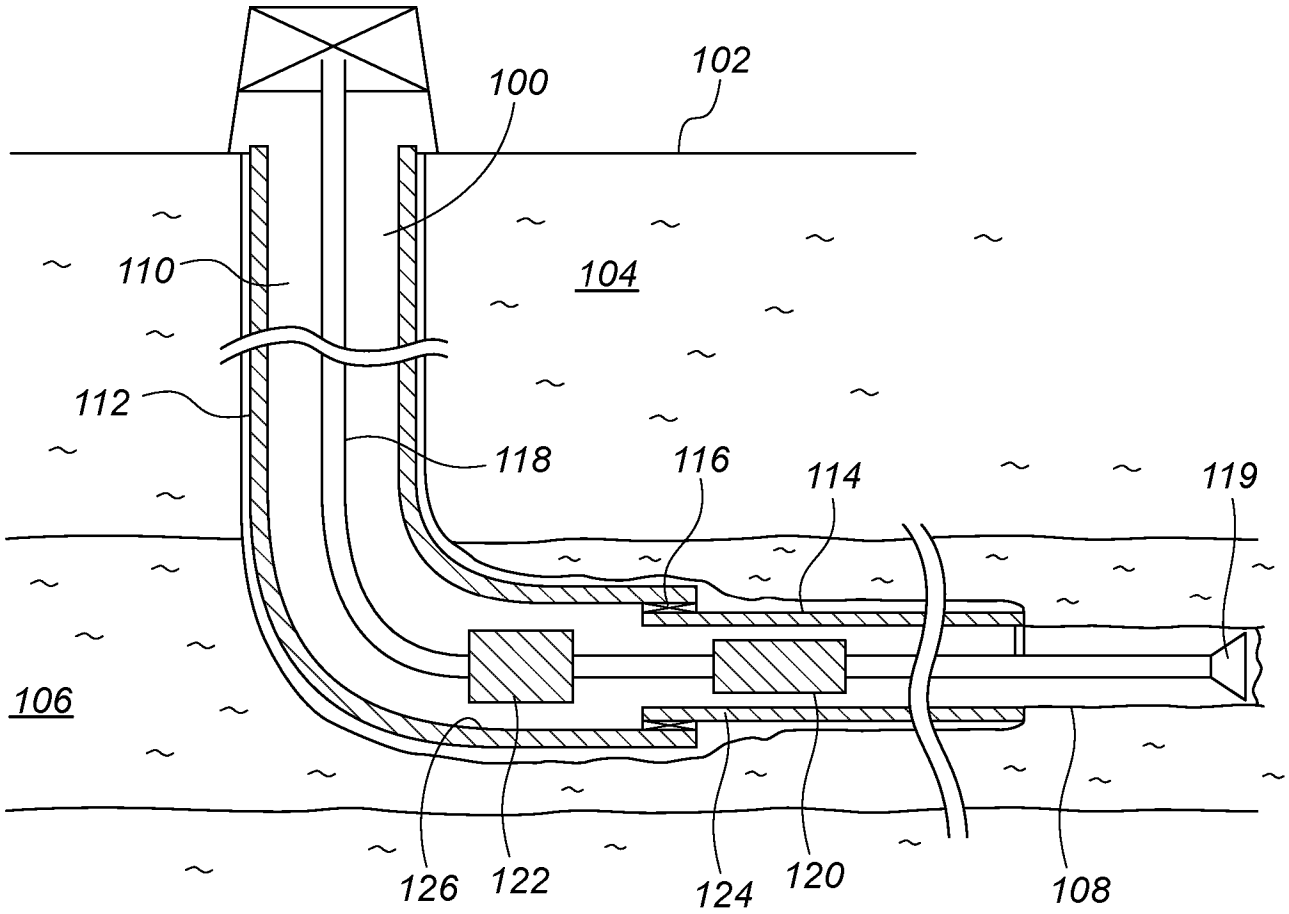
FIG. 1 is a schematic of a downhole operation using a cleaning tool in accordance with an aspect of the disclosure.
Figure 3:
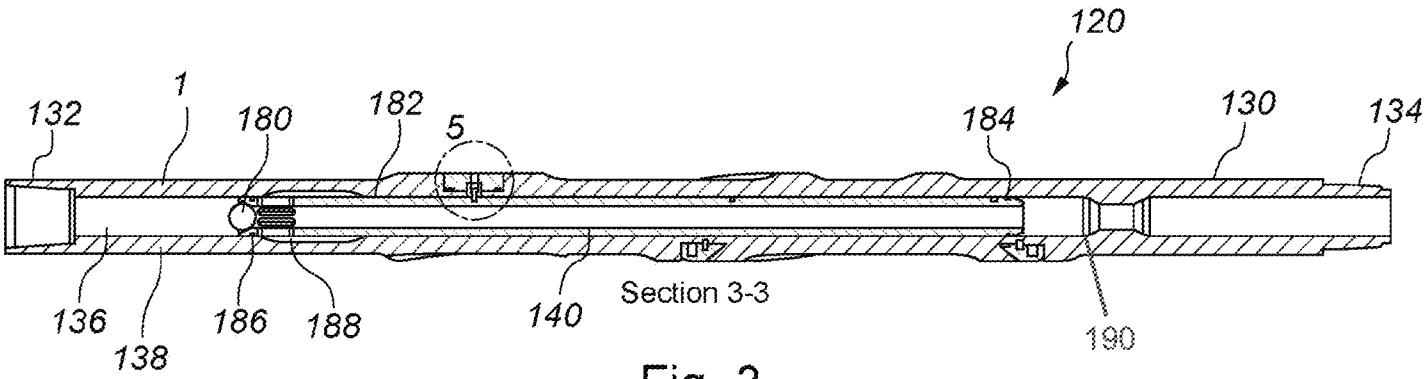
FIG. 3 is a sectional view on line 3-3 of FIG. 2.
Figure 2:
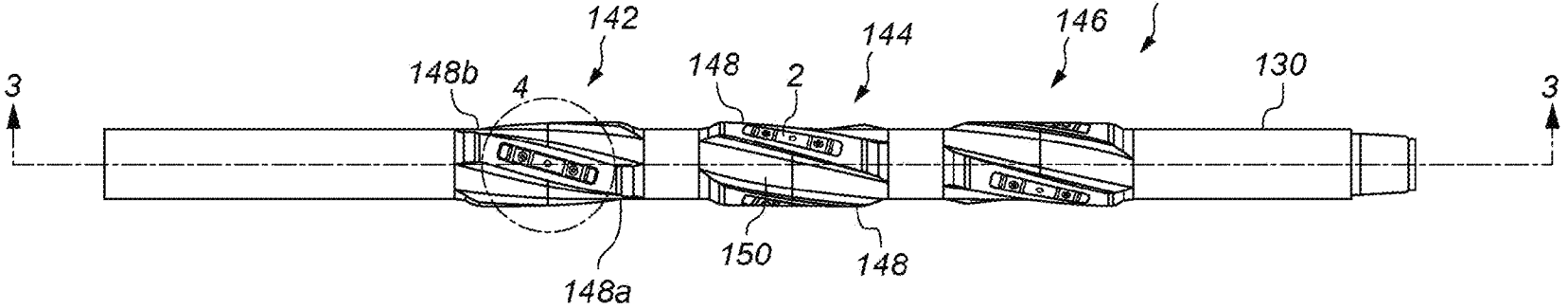
FIG. 2 is an enlarged view of one of the cleaning tools of FIG. 1.
Figure 4:
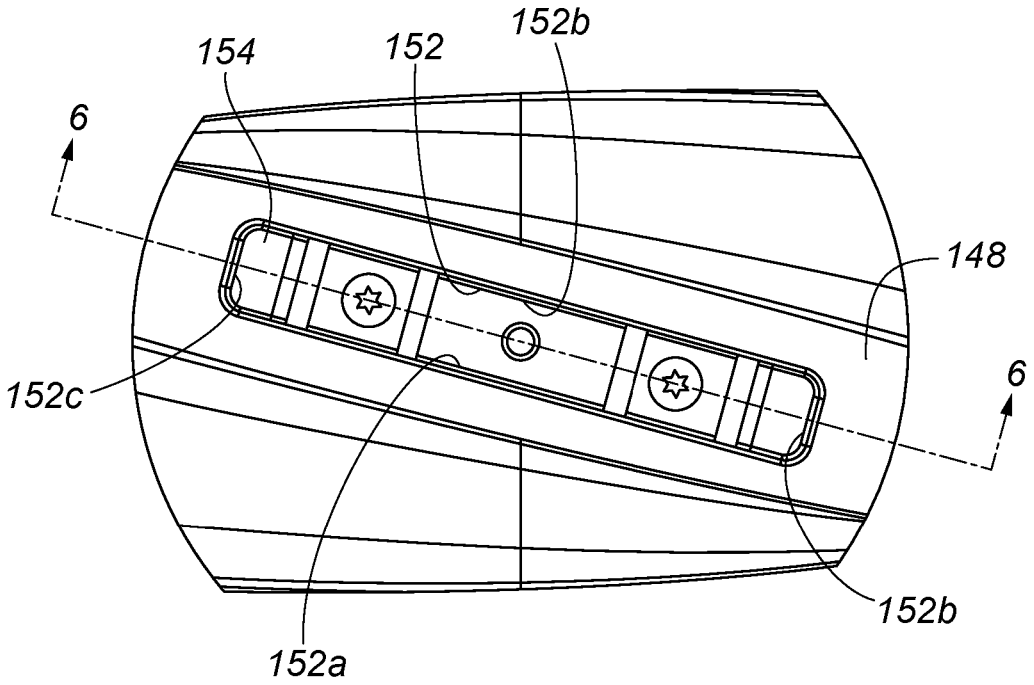
FIG. 4 is an enlarged view of detail 4 of FIG. 2.
Figure 5:
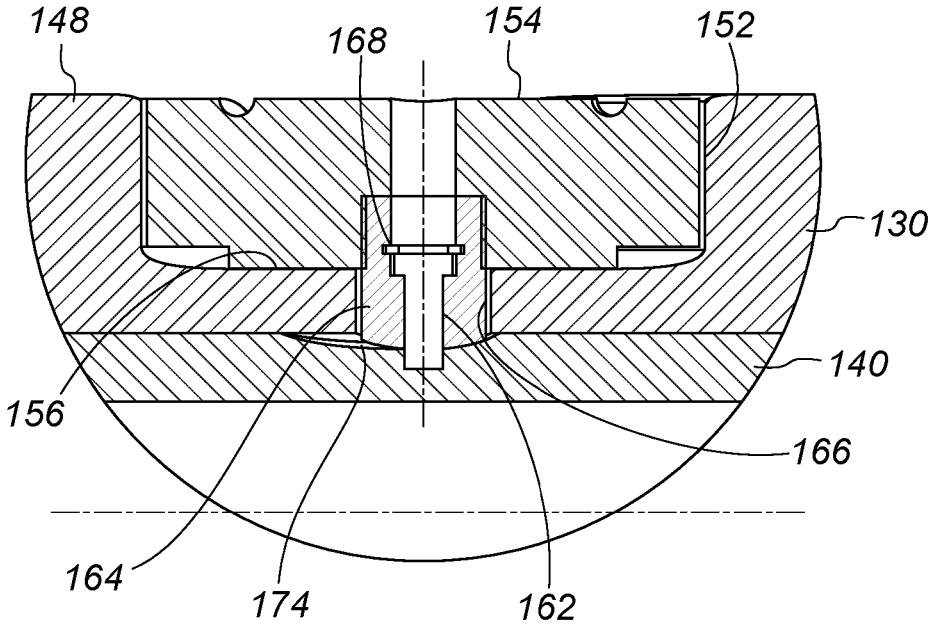
FIG. 5 is an enlarged sectional view of detail 5 of FIG. 3.
Figure 6:
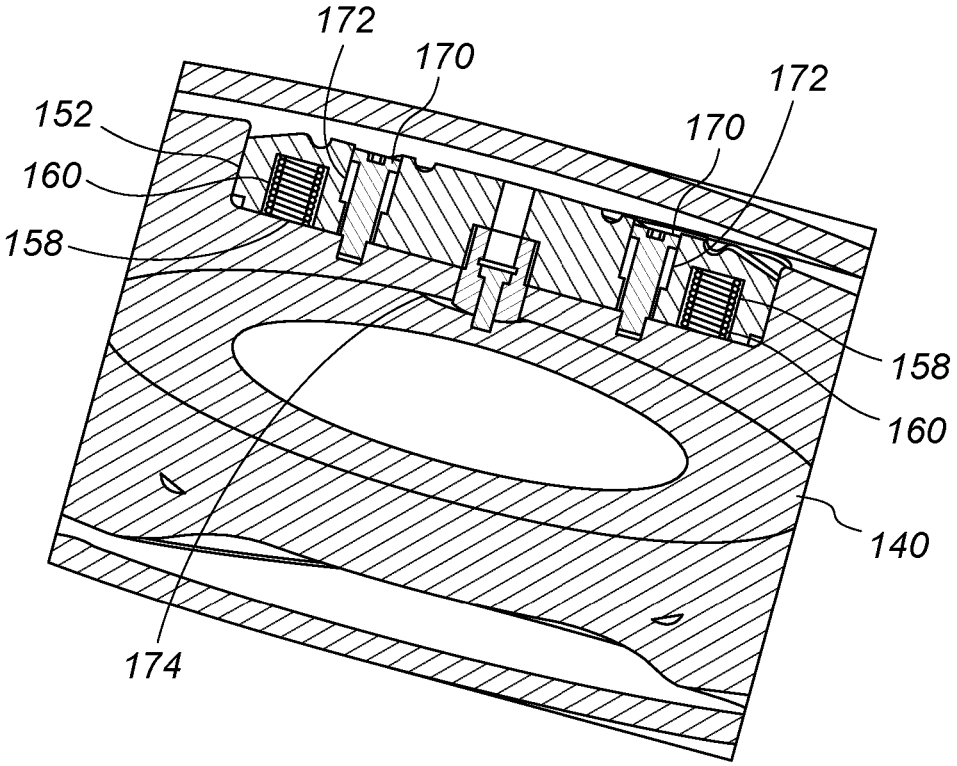
FIG. 6 is a further enlarged sectional view on line 6-6 of FIG. 4.

Reference is first made to FIG. 1 of the drawings, a schematic of a downhole operation. The figure illustrates a well 100 that has been drilled from surface 102 through the earth 104 to access a subsurface hydrocarbon-bearing formation 106. The well 100 includes a substantially vertical section 108 and a substantially horizontal section 110. The vertical section 108 and a part of the horizontal section 110 have been lined with metal tubing in the form of casing 112. In practice, it is likely that multiple coaxial casing sections will have been provided in the well, but for ease of illustration only a single casing 112 is shown. The casing 112 extends back to the surface 102.

The distal portion of the well is provided with a liner 114 and a liner hanger 116 is provided at the upper or proximal end of the liner 114 and has been set to seal and secure the liner 114 to the lower or distal end of the casing 112.

FIG. 1 illustrates the well 100 being drilled beyond the end of the liner 114. A drill string 118 carrying a drill bit 119 has been run into the well 100 and the drill bit 119 rotated to extend the well 100 further through the formation 106. The drill string 118 incorporates two cleaning tools 120, 122 of the present disclosure. The drilling operation locates a smaller diameter distal tool 120 within the liner 114 and a larger diameter proximal tool 122 within the casing 112. As will be described, once the drilling operation has finished, the drill string 118 is partially retrieved to locate the cleaning tools 120, 122 at locations 124, 126 where the liner 114 and casing 112 will subsequently be engaged by hangers or seals provided on other apparatus, such as a further liner and a completion. Once positioned in the locations 124, 126, the cleaning tools 120, 122 are activated, as described in detail below, to extend a plurality of cleaning elements. The drill string 118, and thus the tools 120, 122, are then translated axially through the well 100 such that the cleaning elements are moved across the surfaces of the liner 114 and the casing 112 at the locations 124, 126 to remove or dislodge foreign material from the surfaces. The drill string 118 is subsequently retrieved to surface 102 and other apparatus is run into the well 100 and hangers or seals are set at the cleaned locations 124, 126.

Accordingly, in this example of the present disclosure the requirement to separately run cleaning or scraping tools into the well 100 to prepare the locations 124, 126 to receive hangers or seals is avoided. Of course, the retrieval of the activated cleaning tools 120, 122 through the well 100 will also serve to clean the surfaces of the liner 114 and the casing 112 above the locations 124, 126, and will also serve to ensure the drift diameters of the casing 112 and liner 114, allowing for unobstructed subsequent installation of the next tubing and hangers.

The cleaning tool 120 will now be described in more detail with reference to FIGS. 2 to 8 of the accompanying drawings. The larger diameter cleaning tool 122 is substantially the same as the tool 120 but is configured to engage and clean a larger diameter surface.

The tool 120 comprises a generally cylindrical body 130 configured for incorporation in the drill string 118, and to that end includes appropriate threaded end couplings, an upper box coupling 132 and a lower pin coupling 134. The body 130, which has been machined from a single metal billet, defines a through bore 136 and a body wall 138. The bore 136 accommodates a cam member in the form of an axially translatable pipe 140. Externally, the body wall 138 has been machined to form three axially spaced and circumferentially offset groups of stabiliser blades 142, 144, 146. Each group 142, 144, 146 includes three blades 148 and the blades 148 within each group are separated by bypass flutes 150.

The blades 148 each extend axially and circumferentially around the body 130 with a right-handed helix or spiral, and in this example each blade 148 has a wrap angle (the angle from the front of the bottom or leading end of the blade 148*a* to the back of the top or trailing end of the blade 148*b*) of 90-120°. The wrap angle for each group 142, 144, 146 is the sum of the wrap angles for each blade 148 in the group, that is between 270 and 360°. This provides a clear line of sight through the flutes 150 between the blades 148 and facilitates passage of drilling fluid and entrained material, and any material dislodged during a cleaning operation. The blades 148 of this example are 8-16" (20.3-40.6 cm) long and feature tapered leading and trailing ends. Some or all of the blades 148 may be provided with wear-resistant pads or coatings, for example on the leading and trailing edges and on the outer diameter, to enhance blade longevity.

Each blade 148 defines an external pocket 152 for receiving a generally rectangular cleaning element 154. The pocket 152 and element 154 are of complementary shape and dimensions, the element 154 being a close fit in the pocket 152. The pocket sides 152*a*, 152*b* and the ends 152*c*, 152*d* are parallel and meet at rounded corners, and a main axis of the pocket 152 lies on an ellipse, that is an angled cross-section of the body 130. The base of the pocket and the opposing inner surface of the element 154 are substantially planar/flat. The resulting straight-sided pocket 152 and element 154 facilitates radial movement of the element 154 and provides for stability of the element 154 in the pocket. While a relatively close fit or some other form of close physical engagement between the pocket 152 and the element 154 may be desirable to ensure support for the radially extended element 154, it may be advantageous to facilitate passage of fluid and material between the pocket 152 and the element 154. For example, the corners of the element 154 may be cut off to provide passage for fluid and particulate material as the element 154 moves in and out of the pocket 152. As noted above, the gap between the opposing surfaces of the pocket 152 and the element 154 may fill with fine particulate material which may increase the friction between the parts and may create a seal between the parts. A seal could prevent the element 154 from moving radially outwards due to the creation of a vacuum below the element 154, and could prevent the element 154 from moving radially inwards if fluid or material became trapped between the element 154 and the base of the pocket 152; the relatively large area passage created by cutting off the corners of the element 154 is unlikely to be bridged by fine particulate material and will ensure that fluid and material is not trapped behind the element 154.

The pocket 152 extends into but not through the body wall 138, having a substantially planar base 156 against which a correspondingly shaped inner surface of the element 154 rests when the element 154 is in a dormant or radially retracted position; in an active or extended position the inner surface of the element is radially spaced from the pocket base. The body wall 138 is thus substantially continuous, despite the presence of multiple radially movable cleaning elements 154, maintaining the strength and rigidity of the body 130.

The element 154 is urged towards a radially extended position by two coil springs 158 located in blind bores 160 formed in the inner face of the element 154 and engaging the base of the pocket 152. In the initial, dormant configuration the springs 158 are maintained in a compressed condition by a shear pin 162 which extends between the element 154 and the internal pipe 140. The shear pin 162 is in a central portion of the element 154 within a generally cylindrical cam follower in the form of a plunger 164. The plunger 164 is threaded to the inner face of the cleaning element 154 and extends through a port 166 in the body wall 138. A domed inner end of the plunger 164 rests on an outer surface of the pipe 140, the shear pin 162 extending through the centre of the plunger 164 and the domed surface to engage the pipe 140. The pin 162 has a T-section and when fully engaged with the pipe 140 retains the element 154 in contact with the base of the pocket 152. A circlip 168 is provided in the plunger 164 to retain the head of the sheared pin 162.

The pin 162 is sheared by axial movement of the pipe 140 relative to the body 130, the movement being induced by application of an axial force to the pipe 140, as will be described in detail below. On shearing the pin 162, and assuming there is nothing preventing outwards movement of the element 154, the springs 158 push the element out of the pocket 152 to extend beyond the outer surface of the blade 148. Movement of the element 154 is restricted by stop members in the form of two pins 170 which extend through stepped radial bores 172 in the element and engage with threaded blind bores in the pocket base 156.

As was noted above, the cleaning tool 120 is located on a drill string 118 and is used in an environment where the tool 120 is surrounded by drilling fluid carrying fine particulate material. This material will tend to accumulate in and fill spaces and voids in the tool 120. This effect may be reduced or minimised by filling voids and spaces with a material such as high-temperature grease or wax, however it is likely that some gaps and spaces will be infiltrated by particulate material. If, for example, particulate material migrates into and fills the narrow gap between the walls of the cleaning element 154 and the pocket 152, it is possible that the extension force provided by the springs 158 will not be sufficient to extend the element 154 when the pin 162 is sheared. Accordingly, the tool 120 is configured to provide a significant extension force to the element 154 when the tool 120 is activated.

The inner domed end of the cleaning element plunger 164 engages the outer surface of the pipe 140. With the tool 120 in the dormant configuration, the plunger 164 engages with a lower end of an axial recess or groove 174 in the pipe 140. Nine grooves 174 are provided in the pipe 140 and are arranged as three axially spaced groups of three grooves 174, each groove 174 accommodating the inner end of the one of the plungers 164 of each blade group 142, 144, 146.

The pipe 140 is in sliding sealing contact with the wall of the body bore 136, with upper and lower seals 182, 184 ensuring fluid within the body bore 136 is isolated from external fluid; during a drilling operation the internal fluid pressure will tend to be significantly higher than the external fluid pressure. A further seal 186 is provided at an upper end of the pipe 140, above a set of bypass ports 188 in the pipe wall. Initially the pipe 140 is axially fixed relative to the body by the shear pins 162.

To activate the tool 120, and release and extend the cleaning element 154, the operator drops an occluding member in the form of a ball 180 into the drill string 118. The ball 180 travels down through the string 118 until landing in the upper end of the pipe 140. The ball 180 and the seal 186 allow creation of a differential fluid pressure force across the ball 180 and when the force reaches a predetermined level, equal or more than the cumulative shear ratings of the nine shear pins 162 present in the tool 120, the pins 162 are sheared and the pipe 140 is moved downwards. The grooves 174 in the pipe 140 move downwards relative to the plungers 164 and as the grooves 174 move beyond the plungers 164 the cleaning elements 154 are pushed radially outwards from the body 130. The pressure force across the ball 180 may be significant and will be sufficient to free the cleaning elements 154 from the pockets 152. The springs 158 may then urge the freed elements 154 further from the pockets 152.

Further movement of the pipe 140 relative to the body 130, until the lower end of the pipe 140 engages a tool body bore stop 190, does not change the position of the cleaning elements 154. However, such further translation does move the upper end of the pipe 140, the ball 180, and the bypass ports 188, into an enlarged portion 192 of the body bore 136, such that fluid flowing through the drill string may then bypass the ball 180 and continue beyond the tool 120. Circulation of fluid may be useful to assist with the cleaning operation, assisting in carrying material dislodged by the tool 120 to the surface. The open passage through the drill string 118 also allows the string 118 to self-drain as the string is retrieved.

The larger diameter cleaning tool 122 may be operated in a similar manner, by dropping a larger diameter ball into the tool 122, following activation of the smaller tool 120; the dimensions of the cam member/pipe within the tool 122 are selected such that the smaller ball 180 used in activation of the tool 120 will pass through the upper tool 122.

Figure 7:
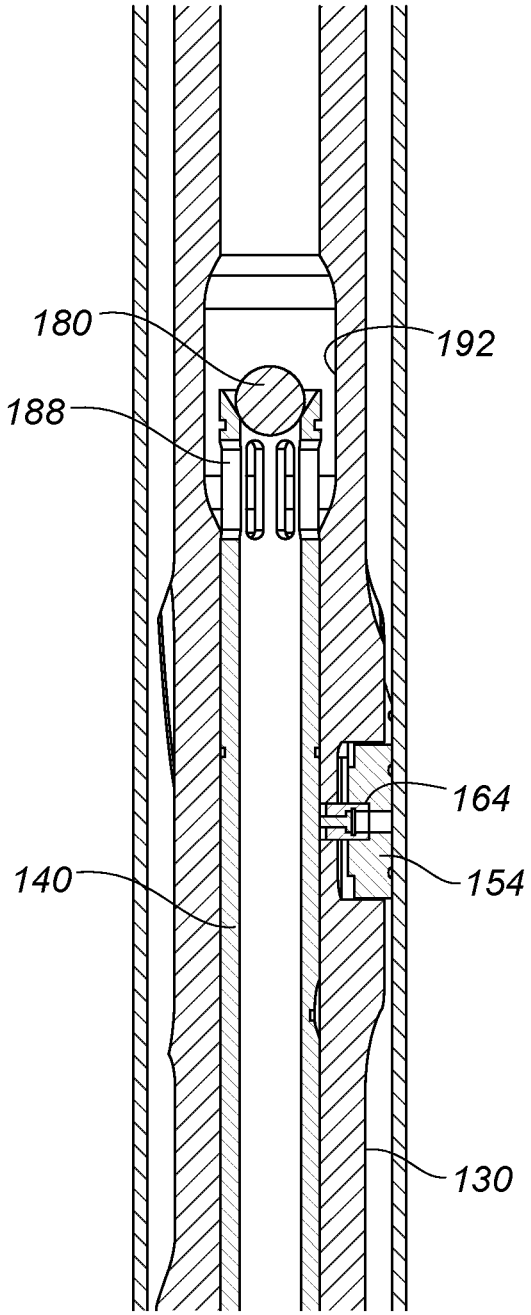
FIGS. 7 and 8 are sectional views of the activated cleaning tool of FIG. 2.
Figure 8:
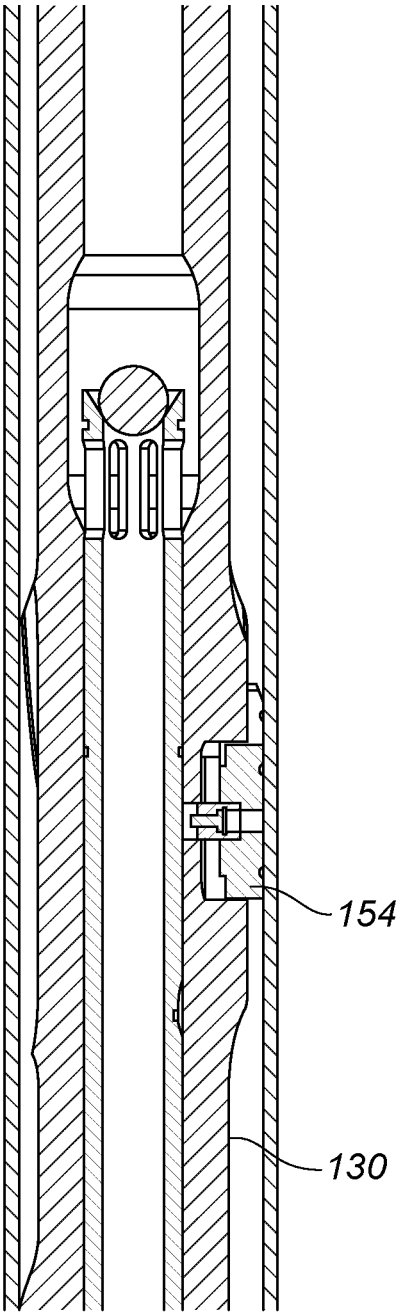

FIGS. 7 and 8 illustrate a cleaning element 154 during a cleaning operation. In FIG. 7 the illustrated element 154 is located within a substantially vertical well section and the tool body 130 is substantially coaxial with the surrounding tubing. It will be noted that the inner end of the plunger 164 has been lifted clear of the surface of the pipe 140 by the springs 158. In such a situation the radial extension of the various elements 154 provided on the body 130 is likely to be substantially the same.

In FIG. 8, the tool body 130 is offset from the surrounding tubing, as may occur in an inclined or horizontal well. The body 130 lies closer to the low side of the well 100 (the left-hand side of the figure) and is spaced further from the high side of the well (the right-hand side of the figure). In this situation the springs 158 push the element 154 on the high side of the well out of the body 130 far enough to achieve contact with the wall of the surrounding tubing.

Axial movement or reciprocation of the drill string 118 results in corresponding axial translation of the activated cleaning tools 120, 122, the extended cleaning elements 154 scraping the walls of the liner 114 and the casing 112. The arrangement of the elements 154 is such that full circumferential or 360° contact between the elements 154 of each tool 120, 122 and the surrounding tubing wall is achieved without requiring rotation of the string 118. Where the tools 120, 122 are incorporated in a drill string 118, rotation of the string 118 and tools 120, 122 is likely to be possible, such that the 360° coverage is not critical. However, in other applications the tools 120, 122 may be used, for example, in a dedicated well bore clean-up run where rotation is not available and the ability to achieve 360° coverage is more important.

The skilled person will understand that the dimensions and arrangement of the cleaning tools 120, 122 may vary depending on the application. However, by way of example, the primary dimensions of a cleaning tool 120 for use in 7" casing (casing having an outer diameter of 7" (178 mm)) will be described. The inside diameter of the casing will depend on the casing weight, for example a 26 lbs/ft (38.7 kg/m) casing may have an i.d. of 6.276" (159.4 mm). The tool 120 may have an overall length of 7.7 ft (2.35 m) and the blades 148 may describe a diameter of 5.81" (148 mm). With the cleaning elements 154 fully extended the tool 120 describes a diameter of 6.760" (172 mm). The external bypass area while dormant within a 7" (178 mm) 26 lbs/ft (38.7 kg/m) casing is 8.69 $in^2$ (5.605 $mm^2$) and while scraping with the cleaning elements 154 extended is 7.99 $in^2$ (5.154 $mm^2$). Each cleaning element is 7" (178 mm) long and 1" (25.4 mm) wide and is inclined at 15° to the axis of the tool 120. The plunger 164 is ⅞" (22.23 mm) in diameter. The port 166 is slightly larger than the plunger 164 and as such is less than $1/10^{th}$ of the area of the pocket base 156 and thus has no significant effect on the structural integrity of the body 130.

The tool 120 may be arranged to receive a 1.72" (44 mm) diameter ball 180 and the tool 120 may be activated by a pressure across the ball 180 of 1500 psi (10.3 MPa).

Figure 10:
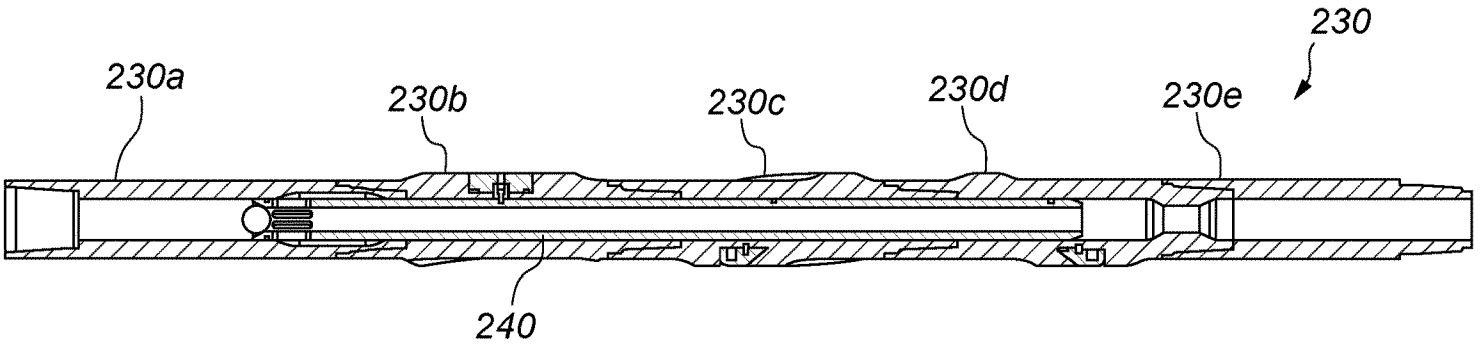
FIG. 10 is a sectional view on line 10-10 of FIG. 9.
Figure 9:
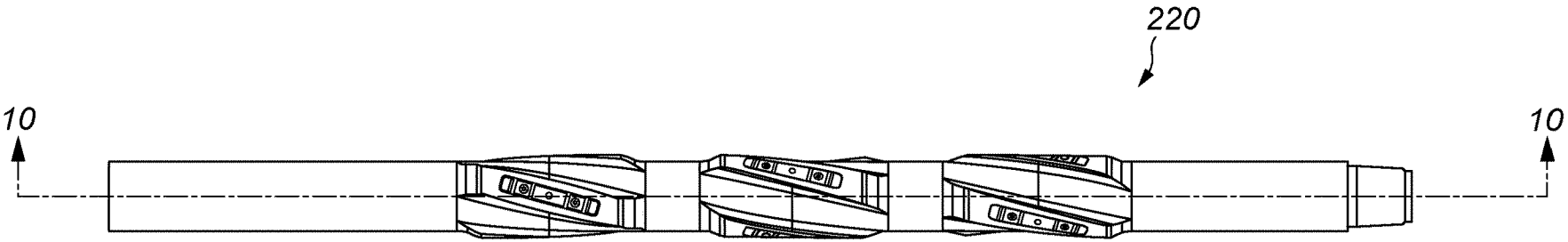
FIG. 9 is a view of an alternative cleaning tool.

FIGS. 9 and 10 of the drawings illustrate an alternative tool 220 which shares many features with the tool 120 described above. However, the tool 220 features a body 230 formed from multiple parts 230*a-e* rather than a single part. Such an arrangement allows a part which has been damaged to be replaced, without having to replace the whole body 230.

Figure 12:
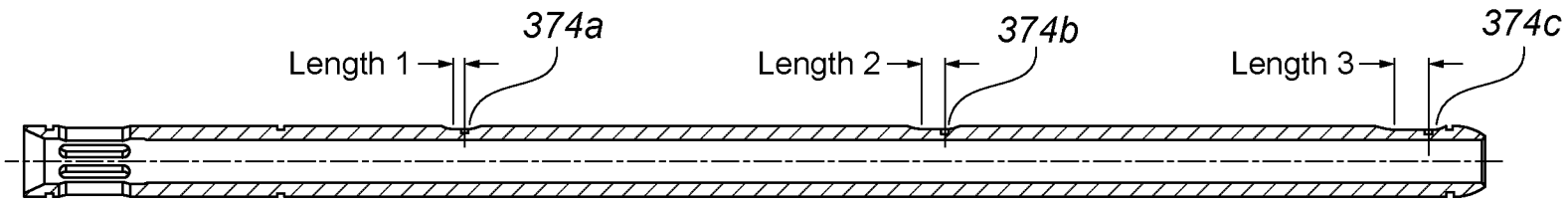
FIG. 12 is a sectional view on line 12-12 of FIG. 11.
Figure 11:
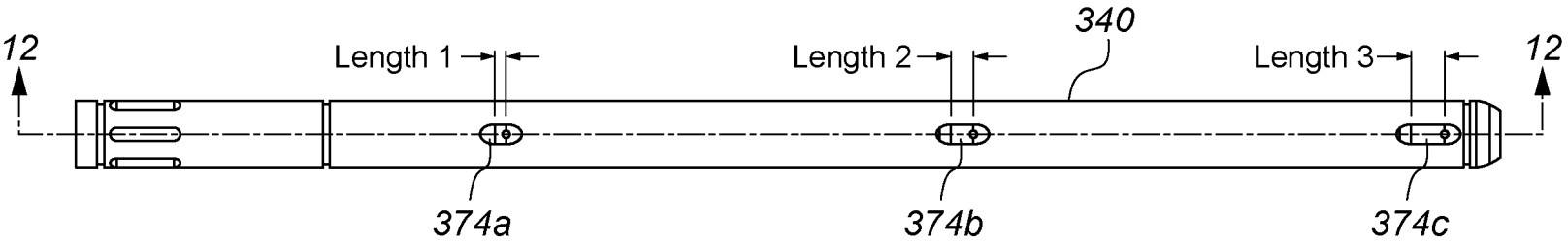
FIG. 11 is a view of a cam member of an alternative cleaning tool.
Figure 13:
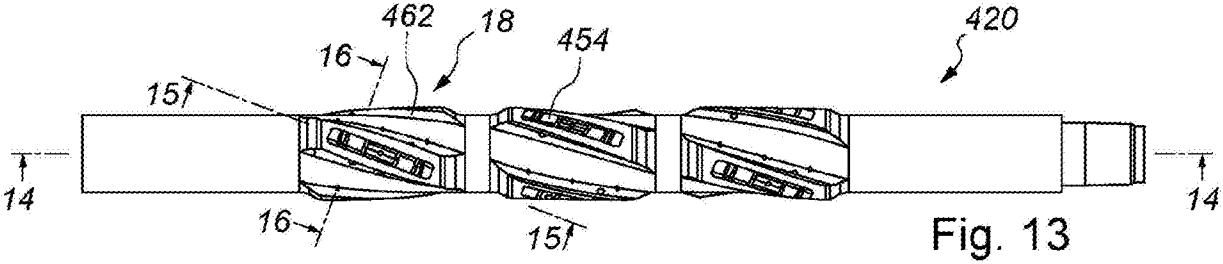
FIG. 13 is a view of a further alternative cleaning tool.

Reference is now made to FIGS. 11 and 12 of the drawings, which illustrate a cam member/pipe 340 of a further alternative cleaning tool. The pipe 340 differs from the pipes 140, 240 of the tools 120, 220 described above, in that the grooves 374 which cooperate with plungers on the sealing elements have different axial extents, in particular the length of the upper or proximal group of grooves 374*a* being less than the intermediate grooves 374*b*, which are in turn shorter than the lower of distal grooves 374*c* (Length 1<Length 2<Length 3). Thus, once the pipe 340 has been moved axially downwards relative to the tool body from the initial dormant or inactive position and the cleaning element retaining pins have been sheared, a further first increment of movement will push the plungers of the upper group of cleaning elements outwards, while the plungers of the intermediate and lower group of elements remain in the dormant or retracted position. A second increment of movement will push the intermediate plungers outwards to extend the second group of elements, and a final third increment of movement will extend the lower group of elements.

This staged or staggered operation offers several advantages. The initial movement of the pipe 340 causes the element retaining pins to shear. In addition to the force required to shear the pins the only other significant resistance to the movement of the pipe 340 will be the friction between the pipe and the surrounding body. Thus, the operator can predict with a reasonable degree of certainty what level of piston force across the occluded pipe will be required to shear the pins and release the elements. The further first increment of movement only extends the upper group of three elements, such that substantially all the axial force being applied to the pipe 340 will be effective to urge the upper elements radially outwards. The operator may thus be confident that the elements will be extended and freed from the pockets, even when the clearance gaps between the elements and the pockets have been filled with particulate material. Similarly, the subsequent second and third increments will extend the intermediate group of elements and then the lower or distal group.

It will be apparent to the skilled person that a cleaning tool in accordance with this disclosure may take other forms from those described above. For example, the number and arrangement of blades 148, pockets 152, and cleaning elements 154 may be varied.

Reference is now made to FIGS. 13 to 19 of the drawings, which are a variety of views of a further alternative cleaning tool 420. As will be described, the tool 420 is provided with an alternative configuration cam member/pipe 440 that provides for staged release and extension of the elements 454 associated with each blade group 442, 444, 446.

Rather than a one-piece pipe as provided on the tools described above, this tool 420 comprises a pipe 440 that is in three parts, a proximal pipe 440*a*, an intermediate pipe 440*b*, and a distal pipe 440*c*. In an initial configuration, in which the cleaning elements 454 are retained in a retracted, inactive configuration, opposing end surfaces 494 of the pipes 440*a*, 440*b*, 440*c* are axially spaced apart, with a lower surface 494*a* of the proximal pipe 440*a* spaced apart from an upper surface 494*ba* of the intermediate pipe 440*b*, and a lower surface 494*bb* of the intermediate pipe 440*b* spaced apart from an upper surface 494*c* of the distal pipe 440*c*.

Coupling or latch arrangements 496 are provided between the pipes 440*a*, 440*b*, 440*c*, providing for a degree of relative axial movement between but preventing axial separation of the pipes 440*a*, 440*b*, 440*c*. In particular, the lower end of the proximal pipe 440*a* is provided with latch fingers 496*a* for engaging with an internal profile 496*ba* on the upper end of the intermediate pipe 440*b*, and the lower end of the intermediate pipe 440*b* is provided with latch fingers 496*bb* for engaging with an internal profile 496*c* on the upper end of the distal pipe 440*c*.

The outer surface of each pipe 440*a*, 440*b*, 440*c* includes three recesses 474 for receiving the inner domed ends of the plungers 464 of the cleaning elements 454 associated with the respective blade group 442, 444, 446. The recesses 474 each further include a blind bore to accommodate the inner end of a shear pin 462.

The upper end of the proximal pipe 440*a* is profiled to receive an occluding member in the form of a dart or ball 480. Upper and lower seals 482*a*, 482*b* are provided on the exterior of the pipe 440*a* to provide a sliding seal with the inner surface of the tool body bore 436 and isolate the ports 466 in the tool body 436 that accommodate the plungers 464. Corresponding seals are also provided on the exterior of the intermediate and lower pipes 440*b*, 440*c*. The upper end of the proximal pipe 440*a* is of slightly larger diameter than the remainder of the pipe 440*a* and features a further exterior seal 486, and the transition between the different diameter pipe portions forms a shoulder 498 which, as will be described, is engageable with a stop 490 formed by the lower end of an enlarged bore portion 492 surrounding an upper portion of the pipe 440*a*, for retaining the pipe 440*a* within the tool body bore 436. The upper end of the pipe 440*a* further includes elongated bypass ports 488 which, when the pipe 440*a* has been axially translated, permit fluid to flow around the occluding ball 480.

The tool 420 differs from the tools 120, 220 in other respects, as will now be described.

Each cleaning element 454 is urged radially outwardly by four coil springs 458, rather than two springs as with the tool 120 described above. The springs 458 engage the base of the respective pocket. The bores 460 that accommodated the springs 458 also feature smaller-diameter passages 461 providing fluid communication with the outer face of the element 454 thus reducing the likelihood of the elements 454 being pressure-locked in the pockets 452. The passages 461 open into grooves 463 which extend across the width of the elements 454 to provide scraping edges to enhance the cleaning effect provided by the elements 454. A shallow wear-indicating groove 465 extends axially along the outer face of each element 454 between the two intermediate scraper grooves 463.

Further, the radial extension of each element 454 is controlled by a pair of retaining pins 470 which extend across the stabiliser blades 448, between the pocket sides 452*a*, 452*b* and through respective radial slots 472 provided in the element 454. The arrangement for retaining the shear pins 462 within the elements 454 is also slightly different, with the shear pin-retaining circlip 468 being provided in a more readily accessible location adjacent the outer surface of the element 454, with a cylindrical rod 469 being provided within the element bore 471 between the circlip 468 and the head of the pin 462.

Figure 19:
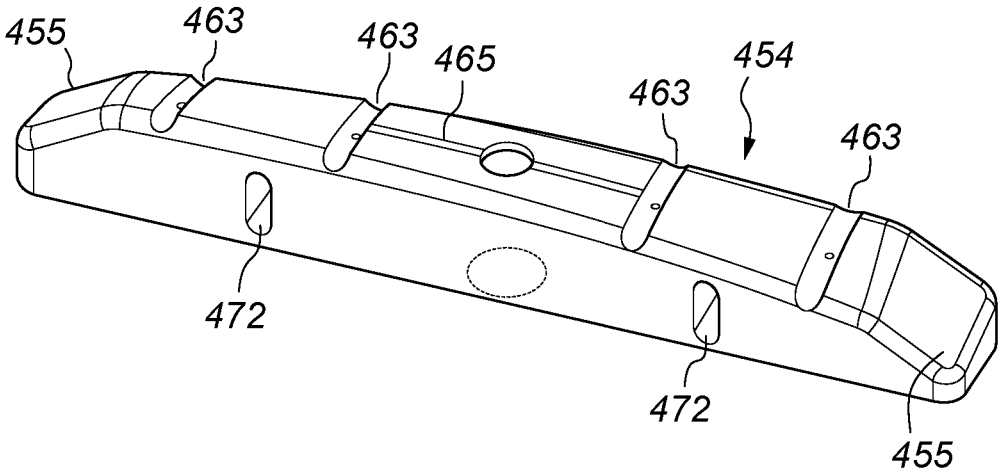
FIG. 19 is an enlarged view of a cleaning element of the tool of FIG. 13.

FIG. 19 illustrates a cleaning element 454 and illustrates the 30° taper at the upper and lower edges of the element 454, which assists in the collapse or radially inwards compression of the elements 454 when the activated tool 420 is being pushed or pulled through the casing and encounters a diameter change or a restriction. Further, the depth/height of the elements 454 is reduced at the leading and trailing corners 455 to mimic the helical form of the adjacent stabiliser blades 448; as with the tool 120 described above, the cleaning elements 454 are generally rectangular and feature a flat/straight lower surface and straight sides, and in the absence of the depth/height reduction the corners 455 would extend proud of the helical blades 448. With the illustrated cleaning element and pocket configuration there is no requirement for the base of the cleaning element to be provides with a complex curved form to allow cooperation with an external cam surface on the pipe 440. In the retracted configuration the flat lower surface of each element engages the corresponding surface of the corresponding pocket 452. Such surfaces are relatively easy to machine and provide for stable mounting of the retracted element in the pocket.

Figure 14:
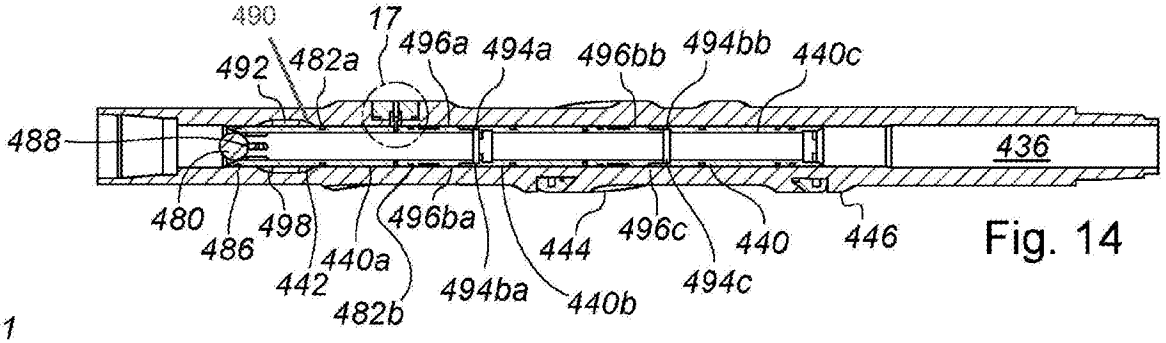
FIG. 14 is a sectional view on line 14-14 of FIG. 13.
Figure 18:
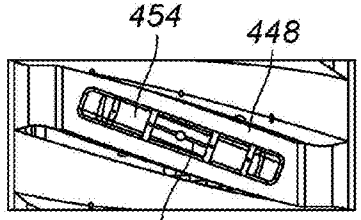
FIG. 18 is an enlarged view of area 18 of FIG. 13.
Figure 17:
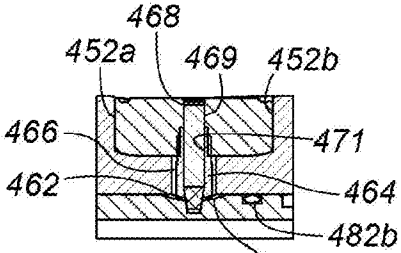
FIG. 17 is an enlarged view of area 17 of FIG. 14.
Figure 16:
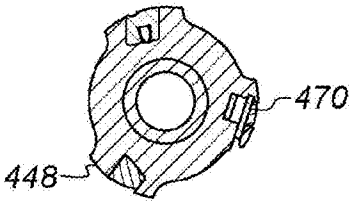
FIG. 16 is an enlarged sectional view on line 16-16 of FIG. 13.
Figure 15:
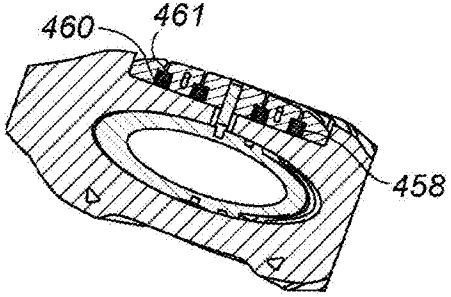
FIG. 15 is an enlarged sectional view on line 15-15 of FIG. 13.

The tool 420 is operated in a generally similar manner to the tools described above. When it is desired to activate the tool and extend the elements 454, the operator pumps the ball 480 from surface and into the tool 420, to land on the upper end of the pipe 440*a*, as illustrated in FIG. 14. It is likely that the momentum of the ball 480, and the column of fluid travelling behind the ball 480, will generate a downwards axial force sufficient to shear the three pins 462 engaging the pipe 440*a* and move the pipe 440*a* downwards. Further downwards movement of the pipe 440*a* also moves the recesses 474 downwards relative to the associated plungers 464, thus pushing the plungers 464, and the associated elements 454, radially outwards. The elements 454 associated with the first blade group 442 are thus extended/activated, and may then be moved further radially outwards, above the surface of the adjacent stabiliser blades 448, by the action of the springs 458.

The downwards axial movement of the pipe 440*a* brings the lower surface 494*a* of the proximal pipe 440*a* into contact with the upper surface 494*ba* of the intermediate pipe 440*b*. Further downwards movement of the pipe 440*a* now also results in downwards movement of the intermediate pipe 440*b*. The momentum of the ball 480 and the following fluid column will still likely be sufficient to generate a downwards axial force sufficient to shear the three pins 462 engaging the pipe 440*b* and move the pipe 440*b* further downwards to move the pipe recesses 474 downwards relative to the associated plungers 464, thus pushing the plungers 464, and the associated elements 454, radially outwards. The cleaning elements 454 associated with the second blade group 444 are thus extended/activated.

This is then repeated for the distal pipe 440*c*, the continuing downwards axial movement of the pipes 440*a*, 440*b* bringing the lower surface 494*bb* of the intermediate pipe 440*b* into contact with the upper surface 494*c* of the distal pipe 440*c*. The pipes 440*a*, 440*b*, 440*c* move downward together and shear the three pins 462 engaging the pipe 440*c* and move the pipe 440*c* further downwards to move the pipe recesses 474 downwards relative to the associated plungers 464, thus pushing the plungers 464, and the associated cleaning elements 454, radially outwards. The elements 454 associated with the third blade group 446 are thus extended/activated.

Further downwards axial movement of the coupled pipes 440*a*, 440*b*, 440*c* is prevented by the shoulder 498 engaging the stop 490.

In use, it is likely that the pipes 440*a*, 440*b*, 440*c* are moved, and the elements 448 of the three blade groups extended, in quick succession, without any operator intervention, immediately following the ball 480 landing in the upper end of the pipe 440*a*. However, in other operations, the ball 480 may drop or be pumped more slowly into the tool 420. The operator may then build up pressure above the ball 480 sufficient to move the proximal pipe 440*a* and extend the proximal cleaning elements 454. The operator may then choose to operate the tool 420 with only the proximal elements 454 extended. More likely the operator will continue to apply pressure to the ball 480 and the occluded pipe 440*a* to move and release the other pipes 440*b*, 440*c*, and release and extend all the elements 454.

This arrangement for actuating the cleaning elements 454 reduces the magnitude of the forces required to fully activate the tool 420, by separating the initiation of movement of the pipes 440*a*, 440*b*, 440*c*. Thus, movement of the proximal pipe 440*a* requires the static friction associated with achieving movement of the relatively short length of pipe 440*a* and associated parts to be overcome, together with the shearing of the three associated pins 462. Once these forces have been overcome the proximal pipe 440*a* will move relatively easily and urge the plungers 464, and the associated elements 454, radially outwards. Once the elements 454 associated with the first blade group 442 are extended/activated the forces being applied to the ball 480 and the pipe 440*a* are then effectively dedicated to the release and translation of the intermediate pipe 440*b* and its associated elements 454. Similarly, once the cleaning elements 454 associated with the intermediate pipe 440*b* have been extended, the coupled pipes 440*a*, 440*b* will move relatively easily and the forces being applied to the assembly are effectively dedicated to the release and translation of the distal pipe 440*c* and the extension of the associated cleaning elements 454.

The use of multiple pipes 440*a*, 440*b*, 440*c* to provide a cam member to actuate the tool 420 facilitates manufacture of the tool 420. The individual pipes 440*a*, 440*b*, 440*c* are machined separately and substantially without reference to the other pipes. On the other hand, manufacturing a one-piece pipe such as the pipes 140, 240, 340 described above requires nine spaced-apart recesses and associated elements to be accurately located relative to one another and to the corresponding elements mounted on the tool body. This requires the machining and assembly of the tool to comply with very fine tolerances and can substantially increase manufacturing costs.

The illustrated example provides three actuating members in the form of the pipes 440*a*, 440*b*, 440*c*, but in other examples only two actuating members could be provided, or four of more actuating members could be provided.

In another example the separate pipes may not be coupled or latched together and may land on a stop or restriction provided in the tool body bore below the lowermost pipe.

In another example, seals may be provided between the cleaning elements and the pockets, and the inner faces of the elements may be arranged to experience internal tool pressure, allowing pressure to be utilised to urge the cleaning elements outwards. Furthermore, seals may be provided between the plungers and the surrounding body ports to prevent ingress of fluid and material from the exterior of the tool into the tool bore, or to permit the plungers to act as pistons and urge the elements radially outwards in response to internal tool pressure.

The illustrated examples use a fluid pressure force-actuated cam member to shear the cleaning element retaining pins and provide an initial cleaning element-extending/releasing force. The extending force may be useful to free the cleaning elements from the pockets should the gaps between the elements and the pockets become packed with material. Once freed from the pockets, the springs may provide for further radial movement of the cleaning elements. As noted above, a pin-shearing or element-extending force may also be provided using the difference in pressure between the interior and the exterior of the body by providing seals on the plungers or the elements and exposing the inner sides of the plungers or elements to internal pressure. In such a situation the radial movement induced by the hydraulic pressure differential may be restricted to prevent the hydraulic pressure urging the elements into contact with the tubing, as this could potentially provide an excessive extending force. This may be achieved by restricting the radial movement of a pressure-activated plunger and permitting the element to move radially outwards of the plunger, for example by providing a flexible link between the plunger and the element or allowing the element to move radially outwards independently of the plunger. The plunger may be stepped or otherwise configured to limit or restrict radial movement.

In a further example of the disclosure a tool may be provided without a cam and may rely solely on hydraulic pressure to control and extend the cleaning elements.

REFERENCE NUMERALS well 100
surface 102
earth 104
hydrocarbon-bearing formation 106
vertical section 108
horizontal section 110
casing 112
liner 114
liner hanger 116
drill string 118
drill bit 119
cleaning tools 120, 122
hanger/sealing locations 124, 126
body 130
box coupling 132
pin coupling 134
body bore 136
body wall 138
cam member/pipe 140
blade groups 142, 144, 146
blade 148
blade bottom leading end 148*a*
blade top trailing end 148*b*
bypass flutes 150
pocket 152
pocket sides 152*a*, 152*b*
pocket ends 152*c*, 152*d*
cleaning element 154
pocket base 156
coil springs 158
blind bores 160
shear pin 162
plunger 164
port 166
circlip 168
stop member/pin 170
stepped bores 172
cam surface/groove 174
ball 180
upper seal 182
lower seal 184
upper end seal 186
bypass ports 188
stop 190
enlarged bore portion 192
tool 220
body 230
body parts 230*a-e*
cam member/pipe 240
cam member/pipe 340
cam surfaces/grooves 374*a, b, c*
cleaning tool 420
tool body bore 436
cam member/pipe 440
proximal pipe 440*a*
intermediate pipe 440*b*
distal pipe 440*c*
blade groups 442, 444, 446
stabiliser blade 448
pockets 452
pocket sides 452*a*, 452*b*
cleaning element 454
element leading/trailing corners 455
coil springs 458
bores 460
communicating passages 461
shear pin 462
scraper groove 463
plungers 464
wear-indicator groove 465
shear pin-retaining circlip 468
cylinder 469
retaining pins 470
cleaning element bore 471
radial slots 472
recesses 474
ball 480
upper seals 482*a*
lower seals 484*a*
upper seal 486
bypass ports 488
stop 490
enlarged bore portion 492
end surfaces 494
lower end surface 494*a*
upper end surface 494*ba*
lower end surface 494*bb*
upper end surface 494*c*
latch 496
latch fingers 496*a*
internal latch profile 496*ba*
latch fingers 496*bb*
internal latch profile 496*c*
shoulder 498

The invention claimed is:

1. A downhole tool comprising;

a tubular body defining an internal bore permitting passage of fluid therethrough;

first and second actuating members located in the bore; the first and second actuating members including cam members and being axially movable relative to the body;

first and second actuatable members mounted on the body, the first and second actuatable members including cam followers and being radially movable relative to the body, the cam follower of the first actuatable member cooperating with the cam member of the first actuating member and the cam follower of the second actuatable member cooperating with the cam member of the second actuating member, and an occluding member, the occluding member being translatable into engagement with the first actuating member to occlude the body bore and permit creation of a fluid-generated force for axially translating the first actuating member whereby the cam member of the first actuating member and the cam follower of the first actuatable member cooperate to radially translate the first actuatable member, and then further translating the first actuating member into engagement with the second actuating member and then further axially translating the second actuating member whereby the cam member of the second actuating member and the cam follower of the second actuatable member cooperate to radially translate the second actuatable member.

2. The tool of claim 1, further comprising a third actuating member and wherein the second actuating member is translatable into engagement with the third actuating member for translating the third actuating member.

3. The tool of claim 1, wherein the first actuating member and the second actuating member comprise sleeves.

4. The tool of claim 1, wherein the first actuating member and the second actuating member are initially releasably retained relative to the body.

5. The tool of claim 1, wherein the first actuating member and the second actuating member are initially releasably retained relative to the body by shear couplings.

6. The tool of claim 1, wherein opposing surfaces of the first actuating member and the second actuating member are initially axially spaced apart.

7. The tool of claim 1, wherein the first actuating member is located axially above the second actuating member in the body.

8. The tool of claim 1, further comprising a stop for the first and second actuating members.

9. The tool of claim 1, wherein the first actuating member and the second actuating member comprise a coupling arrangement whereby the first and second actuating members are coupled together to prevent axial separation of the members.

10. The tool of claim 1, wherein the first and second actuatable members comprise cleaning elements.

11. A method of actuating a downhole tool, the method comprising:

translating an occluding member into a first actuating member located in a body of a downhole tool;

creating a fluid-generated force across the occluding member to translate the first actuating member axially through the body whereby a cam member of the first actuating member cooperates with a cam follower of a first actuatable member and radially translates the first actuatable member;

further translating the first actuating member axially through the body to engage a second actuating member located in the body; and utilising the fluid-generated force to translate the second actuating member axially through the body whereby a cam member of the second actuating member cooperates with a cam follower of a second actuatable member and radially translates the second actuatable member.

12. The method of claim 11, further comprising creating a fluid-generated force across the occluding member and translating the first and second actuating members through the body to engage a third actuating member and utilising the fluid-generated force to translate the third actuating member through the body.

13. The method of claim 11, further comprising initially retaining at least one of the first actuating member and the second actuating member relative to the body, and releasing the retained actuating member to permit translation of the released retaining member through the body.

14. The method of claim 11, further comprising rotating the tool in a bore.

15. The method of claim 11, wherein the actuatable members comprise cleaning elements, and the cleaning elements are radially translated into contact with a surrounding surface.

16. The method of claim 11, further comprising engaging at least one of the first and second actuating members with a stop to limit further translation of the actuating members.

17. The method of claim 11, further comprising coupling the first and second actuating members together to limit axial separation of the members.

* * * * *